US007400128B2

(12) United States Patent
Richardson

(10) Patent No.: US 7,400,128 B2
(45) Date of Patent: Jul. 15, 2008

(54) CURRENT-MODE BANDGAP REFERENCE VOLTAGE VARIATION COMPENSATION

(75) Inventor: Donald Cook Richardson, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 11/221,164

(22) Filed: Sep. 7, 2005

(65) Prior Publication Data

US 2007/0052404 A1 Mar. 8, 2007

(51) Int. Cl.
*G05F 3/26* (2006.01)
*G05F 3/24* (2006.01)

(52) U.S. Cl. ..... 323/315; 323/314

(58) Field of Classification Search ..... 323/315, 323/316, 312, 314
See application file for complete search history.

(56) References Cited

U.S. PATENT DOCUMENTS 6,016,051 A * 1/2000 Can ..... 323/315
6,664,847 B1 * 12/2003 Ye ..... 327/543
7,019,584 B2 * 3/2006 Bartel et al. ..... 327/539

* cited by examiner

*Primary Examiner*—Gary L Laxton
(74) *Attorney, Agent, or Firm*—J. Dennis Moore; W. James Brady, III; Frederick J. Telecky, Jr.

(57) ABSTRACT

A circuit and method for reducing the variation of a reference voltage as a function of resistivity ρ in a current-mode bandgap reference circuit generating a reference current that is applied to an output resistor to generate the reference voltage. According to the invention, a substantially constant current is generated and added to the reference current.

2 Claims, 2 Drawing Sheets

CURRENT-MODE BANDGAP REFERENCE VOLTAGE VARIATION COMPENSATION

TECHNICAL FIELD OF THE INVENTION

The present invention relates to current-mode bandgap reference circuits, and more particularly relates to compensating for variations in reference voltages provided by such circuits across resistors, that arise from process variations.

BACKGROUND OF THE INVENTION

Current mode bandgap reference circuits are widely used in integrated circuits to provide a reference current that is compensated for variation in temperature. In a current mode bandgap reference circuit a current is generated that is a weighted sum of a component that is proportional to a bipolar transistor base-to-emitter voltage (Vbe) and a component that is proportional to a difference of Vbe's, referred to as ΔVbe, or delta Vbe. A reference voltage having a selected value may be produced from such a current by mirroring it into a resistor, with the mirror gain and resistor value chosen to produce the desired voltage. Such an approach has become increasingly popular, since many modern scaled CMOS processes cannot accommodate the normal voltage-mode bandgap voltage of approximately 1.2 volts.

The reason for the choice of current components in a current-mode bandgap reference circuit is the same for a voltage-mode reference circuit, that is, to combine the negative temperature coefficient of a Vbe with the positive temperature coefficient (proportional to absolute temperature, or, PTAT) of a ΔVbe, so as to obtain a current that has an average temperature coefficient of zero, or some other desired value, over a target temperature range, hereinafter referred to as the bandgap current. Note that the ΔVbe is defined as the difference in the Vbes of two transistors that have emitter current densities of a known ratio (diodes can also be used). The current components can be obtained in a circuit by applying the Vbe and ΔVbe voltages across resistors. If these resistors and the resistor used to convert the total current to a reference voltage are all internal to a particular integrated circuit (IC), they can be expected to have been all processed the same. Thus, their absolute values will track from IC to IC, and the temperature coefficient of the reference voltage will depend only on resistor and transistor ratios, and on transistor characteristics that are relatively process-insensitive.

The equation for a reference voltage provided by a current-mode bandgap reference circuit as described above is:

$$Vref=Ibg*Ro, \qquad \text{Eq. (1)}$$

where Vref is the reference voltage output by the circuit, Ibg is the bandgap current and Ro is the output resistor used to convert the bandgap current to the reference voltage. Equation (1) may be expanded:

$$Vref=(Vbe/Rvbe+\Delta Vbe/Rdvbe)*Ro, \qquad \text{Eq. (2)}$$

where Vbe is the base-emitter junction voltage of the negative temperature coefficient contributor transistor, Rvbe is the value of the resistor(s) providing the negative temperature coefficient current contribution, ΔVbe is the delta Vbe of the circuit and Rdvbe is the value of the resistor in the current path providing the PTAT current contribution. The resistor values in Equation (2) may be expressed as device-area-related constants multiplied by the process-sensitive resistivity p of the resistor material. Expanding Equation (2) in this way results in:

$$Vref=(Vbe/(Kvbe*\rho)+\Delta Vbe/(Kdvbe*\rho))*(Ko*\rho), \qquad \text{Eq. (3)}$$

where Kvbe is the device-area-related constant for the resistor(s) providing the negative temperature coefficient current contribution, Kdvbe is the device-area-related constant for the resistor in the current path providing the PTAT current contribution, and Ko is the device-area-related constant for the output resistor used to convert the bandgap current to the reference voltage. It can be seen that in Equation (3) the resistivity factor ρ cancels out, resulting in:

$$Vref=(Vbe/Kvbe+\Delta Vbe/Kdvbe)*Ko, \qquad \text{Eq. (4)}$$

An example of a current-mode bandgap reference circuit that implements this equation, using diodes, is described in *A CMOS Bangap Reference Circuit with Sub-1-V Operation,* by H. Banba, et al., IEEE Journal of Solid-State Circuits, Vol. 34, No. 5 (May 1999), pp. 670-674, which is incorporated by reference herein. Another example, using bipolar transistors and having curvature compensation, is described in *Curvature-Compensated BiCMOS Bandgap with 1-V Supply Voltage,* by P. Malcovati, et al., IEEE Journal of Solid-State Circuits, Vol. 36, No. 7 (July 2001), pp. 1076-1081, and which is also incorporated by reference herein. FIG. 1 is a circuit diagram of the current-mode bandgap reference circuit described in the Malcovati et al. article. Comparing the designations in the above equations with the designations in this circuit, $R_3$ corresponds to Ro, $R_1$ (and $R_2$) corresponds to Rvbe, $R_0$ corresponds to Rdvbe and $Q_1$ is the bipolar transistor determining Vbe, with ΔVbe being determined by the difference between the Vbe's of bipolar transistors Q1 and $Q_2$, the emitter areas of which have a ratio of 1:N. Devices $M_1$, $M_2$ and $M_3$ are PFET transistors configured to mirror current $I_1$ through device $M_3$, i.e., $I_1=I_2=I_3$.

It was mentioned above that the K values in the above equations are device-area-related constants. Specifically, Kvbe, Kdvbe and Ko are expressed as resistor layout ratios, and are relatively process-insensitive. The ratio of bipolar base-emitter current densities that is used to determine ΔVbe is also based substantially on layout geometries. The Vbe term, however, exhibits sensitivity to process variations that is significant in many applications.

A major portion of the variation of Vref due to variation of Vbe is not due to variation in the processing of the bipolar transistors, but, rather, in the variation of Vbe as a function of the resistor resistivity, ρ. The reason for this Vbe variation is that the absolute values of the currents in the bipolar transistors are set by ΔVbe divided by Rdvbe, i.e., the value of resistor $R_0$ in FIG. 1. Referring now to FIG. 1, the following equations apply:

$$Vbe1=(kT/q)*\ln(Ie1/Is), \qquad \text{Eq. (5)}$$

where Vbe1 is the base-emitter junction voltage of transistor $Q_1$, kT/q is the thermal voltage $V_T$ of transistor $Q_1$ (k is Boltzmann's constant, T is absolute temperature and q is the charge of an electron), Ie1 is the emitter current of transistor $Q_1$ and Is is the saturation current of a base-emitter junction for the process used to fabricate the circuit of FIG. 1. Since Ie1=Ie2, Equation (5) may be expressed as:

$$Vbe1=(kT/q)*\ln(Ie2/Is)=(kT/q)*\ln((\Delta Vbe/R0)/Is), \qquad \text{Eq. (6)}$$

where R0 is the value of resistor $R_0$. Applying Equation (6) to Equation (4) yields:

$$Vref=((kT/q)*\ln((\Delta Vbe/(Kdvbe*\rho))/Is)/Kvbe+\Delta Vbe/Kdvbe)*Ko \qquad \text{Eq. (7)}$$

Illustrating Equation (7) quantitatively, assume that the resistor values are chosen so that Vref is a standard bandgap voltage of approximately 1.2 volts. In such a case, Ko/Kvbe is 1, meaning that the small signal gain from Vbe to Vref is 1. Equation (7) shows that Vbe varies as (kT/q)*ln(1/ρ). If kT/q is 0.026 volts and ρ varies by plus or minus 30%, then the variation in Vref over this variation in ρ can be expressed as:

$$\Delta Vref(\rho+/-30\%)=(kT/q)*\ln(1.3/0.7)=0.026*\ln(1.86)=16\text{ mV}. \qquad \text{Eq. (8)}$$

This is a variation of approximately +/−1.3% for a Vref of 1.2 volts. If Vref is used for signal amplitudes, this represents a variation of approximately +/−0.06 dB. In some applications, the gain tolerance allocated to one stage of a signal path can be 0.1 dB or lower. Thus, this source of variation in Vref may be unacceptable in such applications.

SUMMARY OF THE INVENTION

The present invention provides a circuit and method for reduce the variation in Vref of current-mode bandgap reference circuits as a function of ρ. In broad terms, this is accomplished by adding a substantially constant current to the bandgap-based current. In some embodiments the substantially constant current is advantageously obtained my mirroring a scaled reference current obtained from the Vref itself.

These and other aspects and features of the invention will be apparent to those skilled in the art from the following detailed description of the invention, taken together with the accompanying drawings.

DETAILED DESCRIPTION OF THE PREFERRED EMBODIMENT

The making and use of the various embodiments are discussed below in detail. However, it should be appreciated that the present invention provides many applicable inventive concepts which can be embodied in a wide variety of specific contexts. The specific embodiments discussed are merely illustrative of specific ways to make and use the invention, and do not limit the scope of the invention.

As mentioned above, in accordance with the principles of the present invention, the variation of Vref in current-mode bandgap reference circuits as a function of ρ is reduced by adding a constant current to the bandgap-based current. Before describing a preferred embodiment of the invention, the principles of the invention will now be described.

When a constant current, Icorrection, is added to the bandgap current Ibandgap, Vref becomes:

$$\text{Vref}=(\text{Ibandgap}+\text{Icorrection})*\text{Ro}, \text{ or} \quad \text{Eq. (9)}$$

$$\text{Vref}=\text{Ibandgap}*\text{Ro}+\text{Icorrection}*\text{Ro}. \quad \text{Eq. (10)}$$

The first term in Equation (10) is the uncorrected Vref. By inspecting Equation (7), one can see that in a range that is a relatively small portion of the logarithmic factor the dependency of the uncorrected Vref on resistivity ρ can be thought of graphically as a line with negative slope on a graph of Vref versus ρ. This straight line can be expressed as:

$$\text{Vref}=\text{Vref0}-\text{mvr}*\rho+\text{Icorrection}*\text{Ko}*\rho, \quad \text{Eq. (11)}$$

where Vref0 is the value of the reference voltage at the ρ axis intercept and mvr is the absolute value of the slope of the line. If $$\text{Icorrection}=mvr/Ko, \quad \text{Eq. (12)}$$

then $$\text{Vref}=\text{Vref0} \quad \text{Eq. (13)}$$

for all values of ρ. Since the uncorrected Vref function of ρ is actually a portion of a ln(1/ρ) curve instead of a line, it has a very slight upward curvature. If mvr is the absolute value of the average of the slope of this function over the target range of ρ values, the corrected Vref versus ρ function will have an average slope of zero over that same range of ρ values. It will still show the slight upward curvature of the log function, but will be parabolic in appearance with a minimum near the middle of the corrected range.

Figure 1:
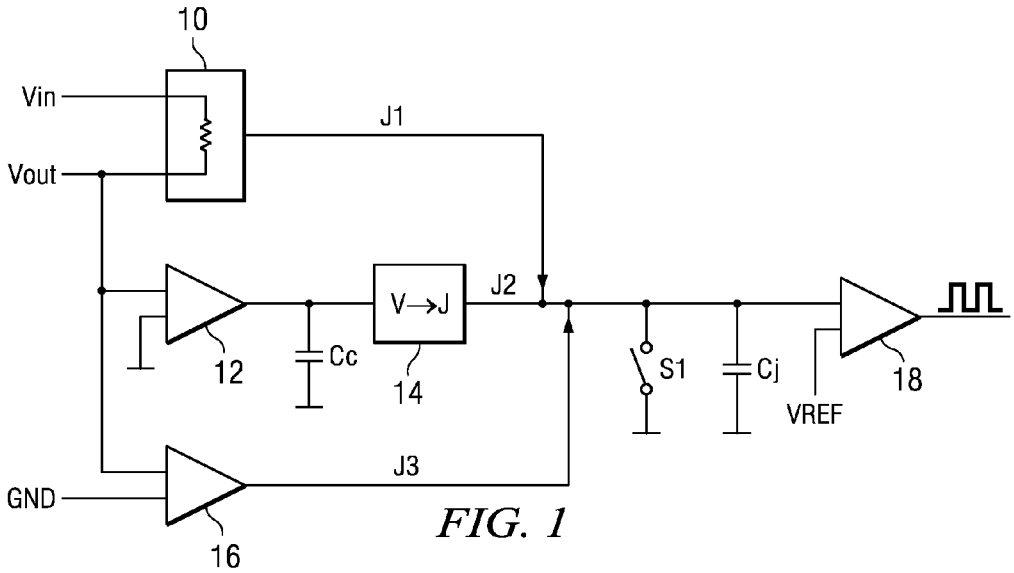
FIG. 1 is a circuit diagram of a representative prior art current-mode bandgap reference circuit.
Figure 2:
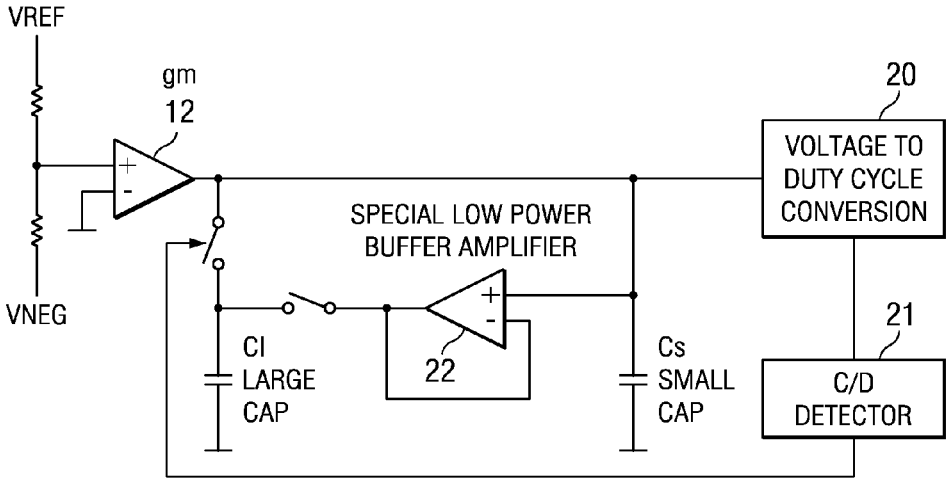
FIG. 2 is a circuit diagram of a current-mode bandgap reference circuit according to a preferred embodiment of the present invention.
Figure 3:
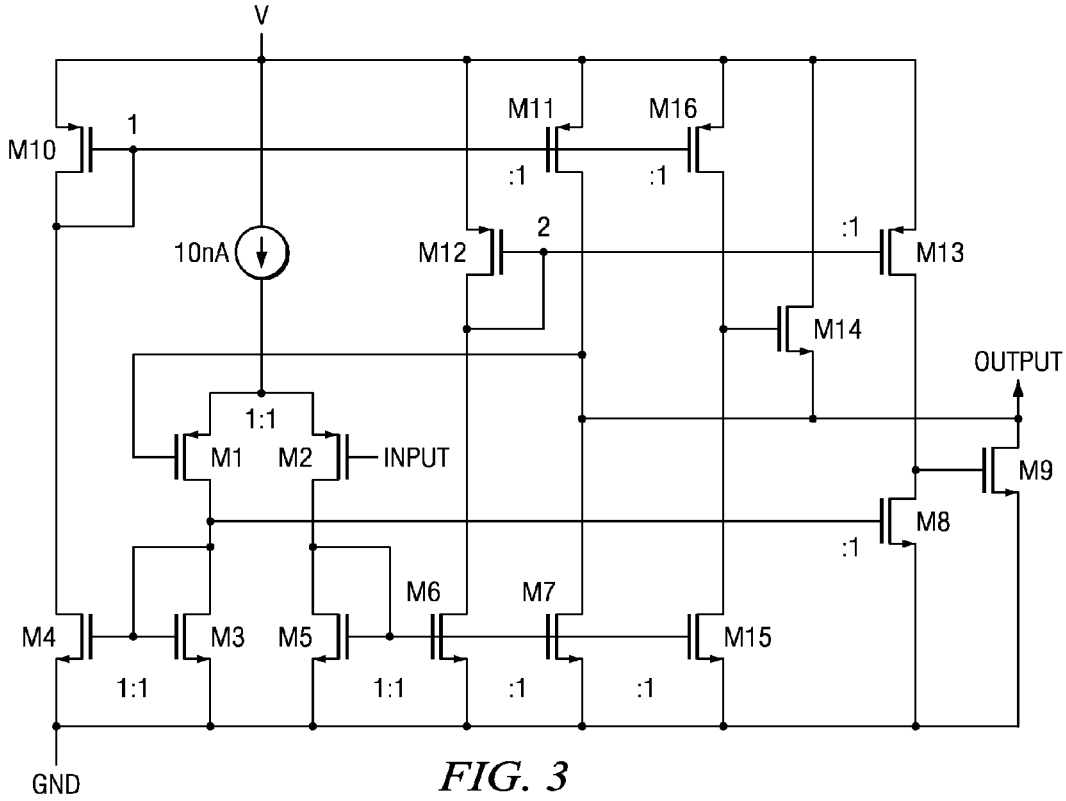
Figure 1:
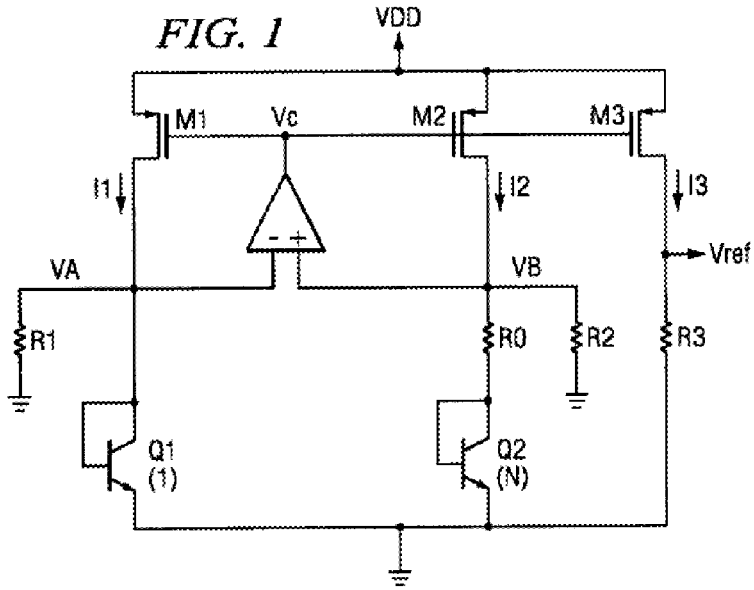
Figure 2:
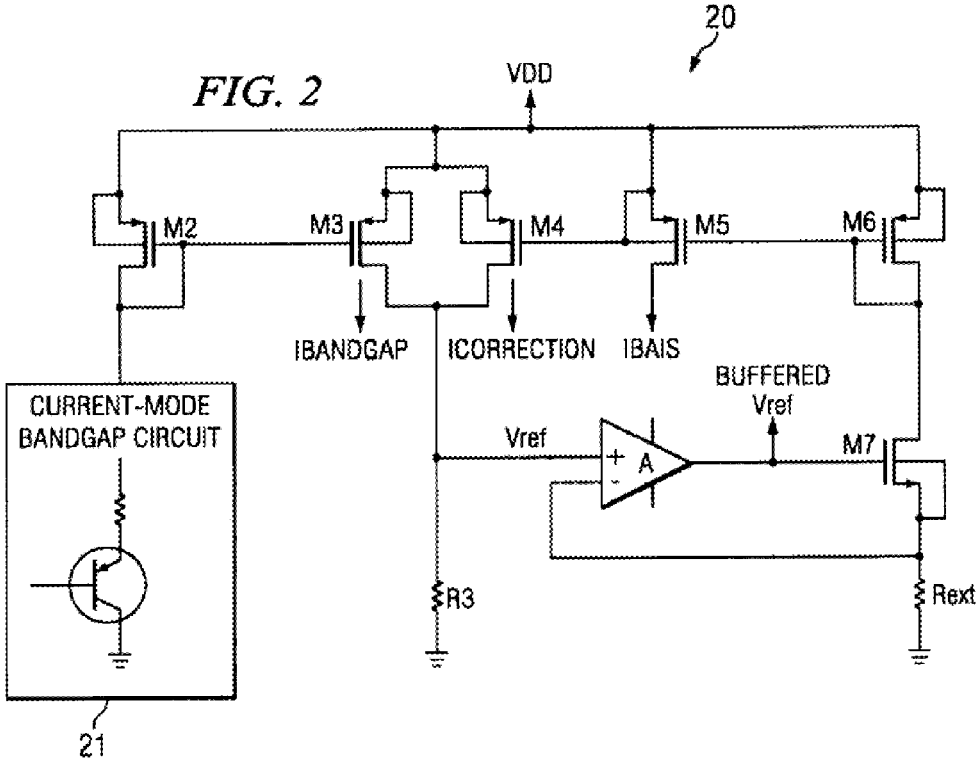

In many applications, a nearly process-insensitive current is derived from a bandgap-based reference voltage by applying that voltage across a precision resistor that is external to the IC. This is often done in order to reduce the variation of bias currents in on-chip amplifiers and also to reduce variation in power consumption. A current derived in this way can also be used as a substantially constant Icorrection even though doing so introduces a small amount of positive feedback in the dependence of Vref on ρ. An embodiment of the present invention implementing this approach is shown in FIG. 2. The current mode bandgap circuit 21 is conventional, for example the circuit shown in FIG. 1. Device $M_2$ is the same as in FIG. 1, as is device $M_3$ and resistor $R_3$, having been depicted outside of circuit 21 in order to show the interface of circuit 21 to the correction circuitry. As can be seen, Vref is applied to the non-inverting input of operational amplifier A, the output of which is applied to the gate of an NFET transistor M7 having its source connected to ground through the external resistor Rext and also connected to the inverting input of operational amplifier A. The amplifier A serves to buffer Vref for use in the correction circuit. The drain of device M7 is connected to the power supply at $V_{DD}$ through a PFET transistor M6 connected in current mirror configuration with PFET transistor M5 to provide the process-insensitive current for other circuitry on the IC (not shown). Device M6 is also connected in current mirror configuration to PFET transistor M4 to generate Icorrection, which is added to Ibandgap, as shown.

The positive feedback referred to in the previous paragraph has a gain that is much less than one because the variation of Vref being corrected is much less than one, so instability, or, in this context, unpredictability, does not result. The effect of this small positive feedback is to increase the amount of upward curvature in the variation of Vref as a function of ρ. This can be seen by modifying Equation (11) to express Icorrection as being generated by such an external resistor, Rext, having Vref applied to it:

$$\text{Vref}=\text{Vref0}-mvr*\rho+(\text{Vref}/\text{Rext})*K8*Ko*\rho. \quad \text{Eq. (14)}$$

Simplifying:

$$\text{Vref}*(1-K8*Ko*\rho/\text{Rext})=\text{Vref0}-mvr*\rho, \text{ and} \quad \text{Eq. (15)}$$

$$\text{Vref}=(\text{Vref0}-mvr*\rho)/(1-K8*Ko*\rho/\text{Rext}), \quad \text{Eq. (16)}$$

where K8 is a factor representing the proportion of Vref/Rext that is used for the correction. The correction in Equation (11) consists of adding a straight line having a positive slope to the uncorrected Vref function of ρ. The correction in Equation (16), however, consists of multiplying by the function 1/(1−(K8*Ko/Rext)*ρ). Since this correction factor has a positive slope for practical positive values of its coefficients, the negative slope of the uncorrected Vref function is still compensated, but the correction factor itself as a function of ρ has a slight upward curvature, which adds to the upward curvature of the log function of the uncorrected Vref function. The resulting upward curvature is still slight for practical values. The coefficients of Equation (16) can be chosen so that the variation of Vref over some expected range of variation in ρ is minimized. Since Ko is likely determined by the reference voltage that is needed by other circuits, the coefficient of interest is K8. The variation of Vref over a range of values of ρ will be minimized if the values of Vref at minimum (ρmin) and maximum (ρmax) values of rho are set to be equal:

$$(\mathrm{Vref0}-mvr*\rho\mathrm{min})/(1-K8*Ko*\rho\mathrm{min}/\mathrm{Rext})=(\mathrm{Vref0}-mvr*\rho\mathrm{max})/(1-K8*Ko*\rho\mathrm{max}/\mathrm{Rext}) \quad \text{Eq. (17)}$$

Solving Equation (17) for K8 will result in a value that will minimize the variation of Vref over the range of ρ between ρmin and ρmax. The resulting curve will resemble a parabola as before.

As an alternative example, it may be desirable to set the slope of the Vref function to be zero at some specific value such as its nominal value in order to minimize the sensitivity of Vref to ρ when ρ is approximately equal to that value. Setting the derivative of Vref with respect to ρ to be zero with ρ set to its nominal value and solving for K8 will result in the value of K8 that will achieve this result.

For both of these correction examples, additional effects not included in the approximate model for the bandgap reference that is used here may make it necessary to depart slightly from the calculations shown in order to achieve the desired result. Note that the currents and resistors are preferably scaled, in order to get the desired value of Vref.

Although the present invention and its advantages have been described in detail, it should be understood that various changes, substitutions and alterations can be made herein without departing from the spirit and scope of the invention as defined by the appended claims.

What is claimed is:

1. A method for reducing the variation of a reference voltage as a function of resistivity ρ in a current-mode bandgap reference circuit generating a reference current that is applied to an output resistor to generate the reference voltage, comprising the steps of:

generating a substantially constant current based on the reference voltage; and adding the substantially constant current to the reference current, wherein the substantially constant current is generated by:

buffering the reference voltage;

applying the buffered reference voltage to a precision resistor to generate a correction current; and mirroring the correction current to a device connected to the output resistor to thereby provide the substantially constant current.

2. A current-mode bandgap reference circuit for generating a reference current that is applied to an output resistor to generate a reference voltage, including circuitry for reducing the variation of the reference voltage as a function of resistivity ρ, comprising:

a first circuit branch for generating a bandgap current;

a second circuit branch for generating a substantially constant current; and a third circuit branch for combining the substantially constant current with the bandgap current, wherein the third circuit branch for combining the substantially constant current with the bandgap current comprises a fourth circuit branch for generating the substantially constant current based on the reference voltage, wherein the fourth circuit branch for generating the substantially constant current based on the reference voltage comprises:

a buffer circuit for buffering the reference voltage;

a precision resistor configured to have the buffered reference voltage applied to it to generate the correction current;

a device connected to the output resistor; and a current mirror for mirroring the correction current to the device connected to the output resistor to thereby provide the substantially constant current.

* * * * *

UNITED STATES PATENT AND TRADEMARK OFFICE

CERTIFICATE OF CORRECTION

PATENT NO. : 7,400,128 B2
APPLICATION NO. : 11/221164
DATED : July 15, 2008
INVENTOR(S) : Donald Cook Richardson It is certified that error appears in the above-identified patent and that said Letters Patent is hereby corrected as shown below:

Replace the title page and sheet 1 of 2 of the drawings as shown in the attached pages.

Signed and Sealed this

Sixth Day of January, 2009

JON W. DUDAS
*Director of the United States Patent and Trademark Office*

(12) United States Patent
Richardson

(10) Patent No.: US 7,400,128 B2
(45) Date of Patent: Jul. 15, 2008

(54) CURRENT-MODE BANDGAP REFERENCE VOLTAGE VARIATION COMPENSATION

(75) Inventor: Donald Cook Richardson, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 11/221,164

(22) Filed: Sep. 7, 2005

(65) Prior Publication Data

US 2007/0052404 A1 Mar. 8, 2007

(51) Int. Cl.
*G05F 3/26* (2006.01)
*G05F 3/24* (2006.01)

(52) U.S. Cl. ..... 323/315; 323/314

(58) Field of Classification Search ..... 323/315, 323/316, 312, 314
See application file for complete search history.

(56) References Cited

U.S. PATENT DOCUMENTS 6,016,051 A * 1/2000 Can ..... 323/315
6,664,847 B1 * 12/2003 Ye ..... 327/543
7,019,584 B2 * 3/2006 Bartel et al. ..... 327/539

* cited by examiner

*Primary Examiner*—Gary L Laxton
(74) *Attorney, Agent, or Firm*—J. Dennis Moore; W. James Brady, III; Frederick J. Telecky, Jr.

(57) ABSTRACT

A circuit and method for reducing the variation of a reference voltage as a function of resistivity ρ in a current-mode bandgap reference circuit generating a reference current that is applied to an output resistor to generate the reference voltage. According to the invention, a substantially constant current is generated and added to the reference current.

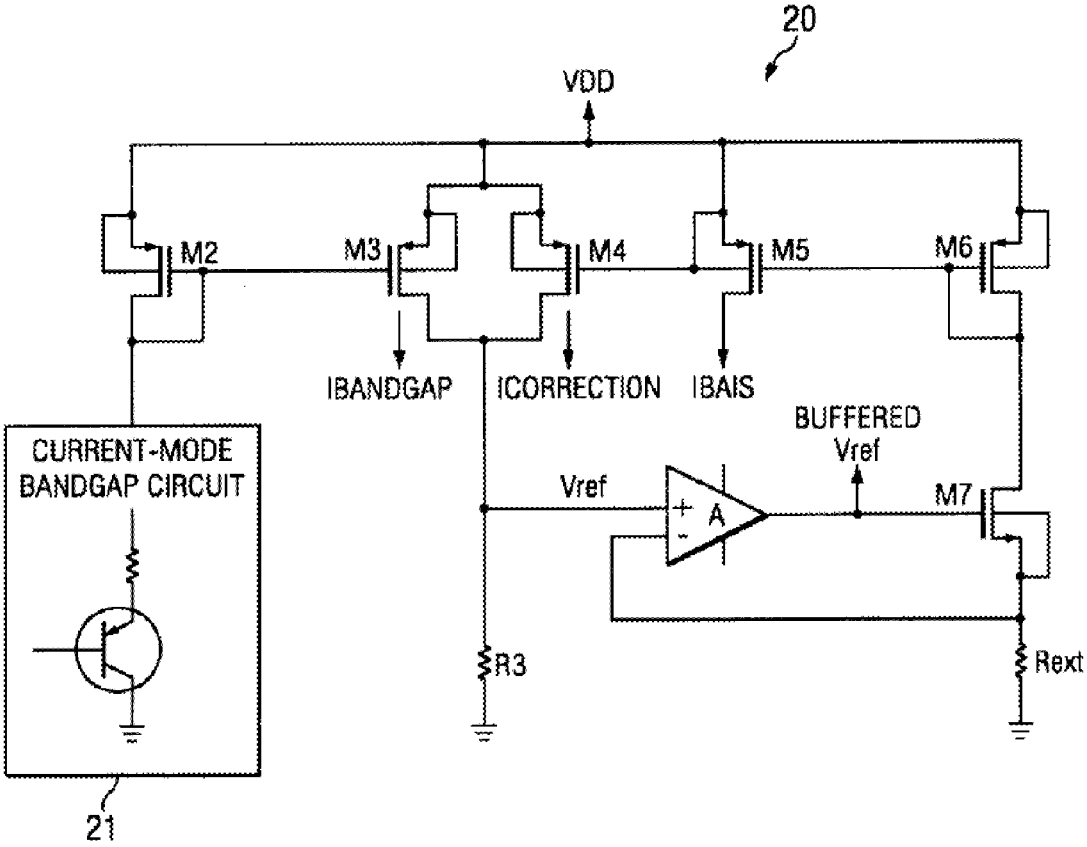

2 Claims, 2 Drawing Sheets